US005979691A

United States Patent [19]

Von Holdt

[11] Patent Number: 5,979,691

[45] Date of Patent: Nov. 9, 1999

[54] CONTAINER AND LOCKING LID

[76] Inventor: John W. Von Holdt, 6864 Lexington La., Niles, Ill. 60648

[21] Appl. No.: 09/058,673

[22] Filed: Apr. 10, 1998

[51] Int. Cl.[6] ..... B65D 45/16; B65D 41/32

[52] U.S. Cl. ..... 220/266; 220/786; 220/788; 220/326; 220/4.24

[58] Field of Search ..... 220/265, 266, 220/784, 786, 788, 324, 326, 309.2, 4.21, 4.24; 215/250, 253, 317, 321

[56] References Cited

U.S. PATENT DOCUMENTS

| | | | |
|---|---|---|---|
| 3,840,152 | 10/1974 | Hodge | 220/784 X |
| 4,212,415 | 7/1980 | Neely | 220/324 X |
| 4,574,974 | 3/1986 | von Holdt . | |
| 4,585,138 | 4/1986 | Jonkers | 220/784 X |
| 4,607,759 | 8/1986 | Boetzkes | 220/266 |
| 4,735,337 | 4/1988 | Von Holdt . | |
| 4,782,977 | 11/1988 | Watanabe et al. | 220/324 |
| 5,235,795 | 8/1993 | DeBusk | 220/908 X |
| 5,238,134 | 8/1993 | Knapp | 220/266 |
| 5,348,549 | 9/1994 | Brown et al. | 220/908 X |
| 5,410,967 | 5/1995 | Peritt | 220/266 X |
| 5,520,301 | 5/1996 | Sohn | 220/265 |
| 5,551,589 | 9/1996 | Nakamura | 220/4.21 X |
| 5,829,610 | 11/1998 | Rohr et al. | 220/265 X |

*Primary Examiner*—Stephen K. Cronin
*Assistant Examiner*—Nathan Newhouse
*Attorney, Agent, or Firm*—Gerstman, Ellis & McMillin, Ltd.

[57] ABSTRACT

A two-piece, connectable article comprises a first piece and a second piece which fit together in a connected position. One of the first and second pieces has a plurality of integral, extending members having free ends that each define a latch member. The other of the first and second pieces has a facing wall that defines a plurality of apertures positioned to receive the free ends of the extending members in the connected position. The apertures are sized to cause flexing of the latch members as the latch members are placed through the apertures to assume the connected position. The extending members and facing wall are proportioned to permit the latch members to spring back to an original position in the connected position, to effectively prevent separation of the first and second pieces until at least some of the extending members are broken away.

20 Claims, 4 Drawing Sheets

CONTAINER AND LOCKING LID

BACKGROUND OF THE INVENTION

Large containers of typically one-quart to fifteen gallons are in widespread usage for holding a wide variety of products such as paint, solvents, liquids, and dry products such as chemicals, plastic precursors, and the like. Many or most of these containers are of the wide-mouthed type, where the mouth of the container is almost as wide as the maximum diameter of the container, with the lid fitting in some form of snap-fit manner on the lip of the container.

A wide variety of designs has been proposed for containers of this type. As one method of testing such designs for efficacy and practicality, they are subject to drop tests. The container is filled with liquid, closed with a lid across its wide mouth, and dropped in inverted position from a height ranging from 24 inches to 4 feet, to see if the lid will pop off under such stress. Such testing obviously eliminates a large number of the many proposed designs for wide-mouthed, large containers.

Particularly, large, square containers have had difficulty in passing drop testing. Also, square containers have difficulties of sealing, since O-rings at the mouths of such containers which form a seal between the container and lid are more likely to form leaks at the corners than is the case with cylindrical containers.

Accordingly, there is a need for large, molded plastic, wide-mouthed containers which both pass stringent drop testing and which are of reduced costs when compared with the current commercial, rectangular containers. Also, there is a need for large, rectangular containers which have good sealing with or without an O-ring, which sometimes performs in a deficient manner in rectangular containers by permitting leakage at the corners.

By this invention, such a container and lid is provided, having greatly improved resistance to lid pop-off. The container and lid can be preferably of rectangular cross-section, although the invention may be used with cylindrical containers, or containers of other shapes, if and as desired, with or without O-rings for sealing. Also, the invention can be used between any desired, connectable articles and not just wide-mouthed containers with sealable lids: for example, one, two or multiple piece housings or casings for various items such as television sets or other appliances, machinery, instrumentation, or the like. The two-piece, connectable article of this invention may actually comprise multiple pieces if desired, with various pieces using the invention described herein, but for simplicity, they are all described as a "two-piece connectable article" since they have two pieces that connect in accordance with this invention.

Such articles can be snapped together with ease; can exhibit a sealing function together if desired; and are not effectively separable without the destruction of certain parts of the system, to provide a tamper-proof indication that the closed system has been opened. Also, the respective pieces of the connectable article of this invention can be easily molded if desired, although the pieces could have resilient metal components if desired, formed by a non-molding process. All things being equal, the molding of the respective pieces can be inexpensive relative to competing systems.

Also, the containers and other connectable articles of this invention can have a clear, tamper-evident feature, showing when they have been initially opened.

DESCRIPTION OF THE INVENTION

In accordance with this invention, a two-piece, connectable article comprises a first piece and a second piece which fit together in a connected position. One of the first and second pieces has a plurality of integral, extending members having free ends that each define a latch member. The other of the first and second pieces has a facing wall that defines a plurality of apertures positioned to receive the free ends of the extending members in the connected position. The apertures are sized to cause inward flexing of the latch members as the latch members are placed through the apertures, to assume the connected position.

The extending members and facing wall are proportioned to permit the latch members to spring back to their original position in the connected position, to prevent separation of the first and second pieces until at least some of the extending members are broken away.

The invention finds particular, advantageous use in which the respective pieces comprise a container and a lid. The extending members, the latch members passing through the apertures, and their springing outwardly to prevent retraction again all provide a container which can have excellent drop resistance as well as a tamper-proof indication of opening.

To open the container, some or all of the extending members may be severed. Then, optionally, a second snap-latch sealing system may be provided, permitting repeated, non-destructive connection and separation of the first and second pieces. Such a snaplatch system may comprise a known plastic sealing closure system for a bucket lid of a snap-seal type, so that the container can be re-sealed after opening.

The latch members carried on the ends of the extending members may comprise a hook, formed by the bending over of the extending member. The extending member may be a flat, plastic strip integral with one of the first or second pieces, particularly, the container lid. In one embodiment, the latch members also may carry a spur member extending away from the hook and on the other side of the extending member, for engaging a back surface of the facing wall in locking manner.

As further alternatives, the latch member may be of substantially T shape or arrowhead shape, as shown in specific embodiments herein. If desired, the various designs of latch members may be used together so that various integral, extending members have differing designs of latch members. Many shapes may be used for the latch member, for example shapes that bend more easily in one direction when inserted through the aperture than in the other direction when withdrawal back through the aperture is attempted.

As another embodiment, one of the pieces, for example, the container lid, may have added, integral extending members carrying end latches that can pass into added apertures of the other of the pieces. The added apertures would then be carried by the container body. The added apertures may be oversized to permit manual disengagement of the added, integral extending members from the added apertures without breaking away of the added extending members.

Thus, after the first category of extending members are cut away or otherwise severed, the added, integral extending members may be manually deflected, to permit their removal from the oversized apertures in a non-destructive manner, to permit separation of the two pieces in a manner which is child-resistant, so that a container, for example, has a lid that is removed only with greater difficulty by a child.

DESCRIPTION OF SPECIFIC EMBODIMENTS

Figure 1:
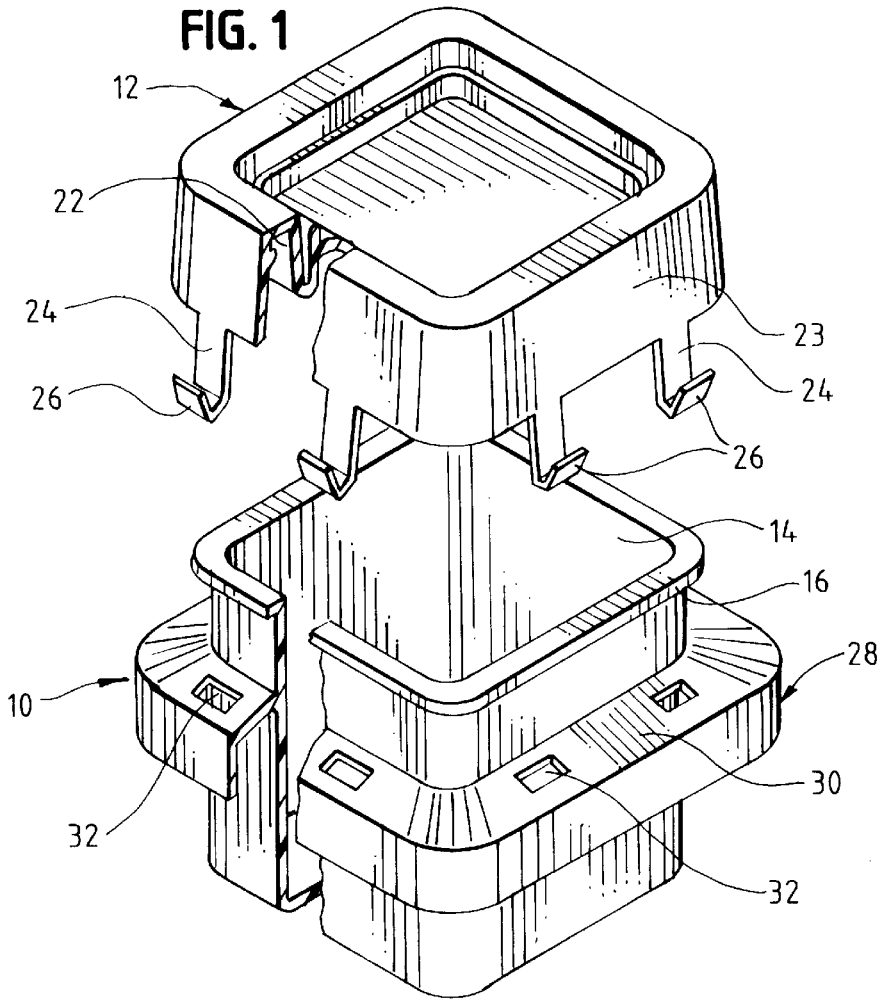
FIG. 1 is a perspective view of a container and lid in accordance with this invention, with the container and lid being separated.

Referring to FIGS. 1 through 5, a molded plastic container 10 is shown, having a lid 12, the container and lid being designed to be connected together in a manner that strongly resists pop-off on dropping, and yet which permits re-sealing after an initial opening.

Container 10 defines an open mouth 14 in the typical manner of a wide-mouthed container, with mouth 14 being defined by an outer container end having an outwardly projecting rib 16. Lid 12 fits over open mouth 14 and outwardly projecting rib 16, with a snap-in sealing system 22 of generally conventional design being provided by a circumferential aperture 18, and an inwardly extending, continuous rib 20 to engage rib 16, as particularly illustrated in FIGS. 3 and 5. Thus container 10 and lid 12 latch together in sealing manner with a lip seal, which may be generally conventional design. This sealing system comprises the second snap-latch system described above.

In accordance with this invention, lid 12 has a plurality of integral, extending members 24 comprising strips extending downwardly from each side of lid 12 and integral with the molded lid. Extending members or strips 24 have free ends that each define a latch member 26, shown here to be a simple hook structure as an integral part of each strip 24.

Container 10 defines a circumferential flange 28 which, in turn, comprises a facing wall 30 (i.e., facing the strips 24 and latch members 26 as they are advanced). Facing wall 30 defines a plurality of apertures 32, which are positioned to receive strips 24 and latches 26 as lid 12 is advanced into closing relationship over the mouth 14 of container 10. Also, apertures 32 are proportioned so that as the lid 12 closes onto container 10, the free ends of extending members 24, and particularly latch members 26, respectively pass through the apertures 32 and, in so doing, latch hooks 26 are flexed inwardly by the constricted widths of apertures 32 as they pass through the apertures. Extending members or strips 24 are long enough to permit each latch member 26 to pass completely through its connected aperture, so that the latch member hooks 26 all spring back outwardly again after they pass through their respective apertures 32, and occupy a space below facing wall 32, as in FIG. 3. Thus, the outward springing of the hooks 26 back to their original position causes it to be effectively impossible for lid 12 to be removed from container 10 again without severing most of extending member strips 24.

Thus, a strong, sealed-lid container system is provided which can be of substantial size, and which is strongly resistant against lid pop-off. At the same time, sealing can be provided by the second, snap-latch sealing system 22, which may be of a type that provides good sealing, but is not in itself very effective for the prevention of accidental pop-off of the lid through dropping. By this invention, the second, snap-latch system 22 does not have to be strongly resistant to lid pop-off, since that resistance is provided by extending members 24 secured in apertures 32.

Figure 2:
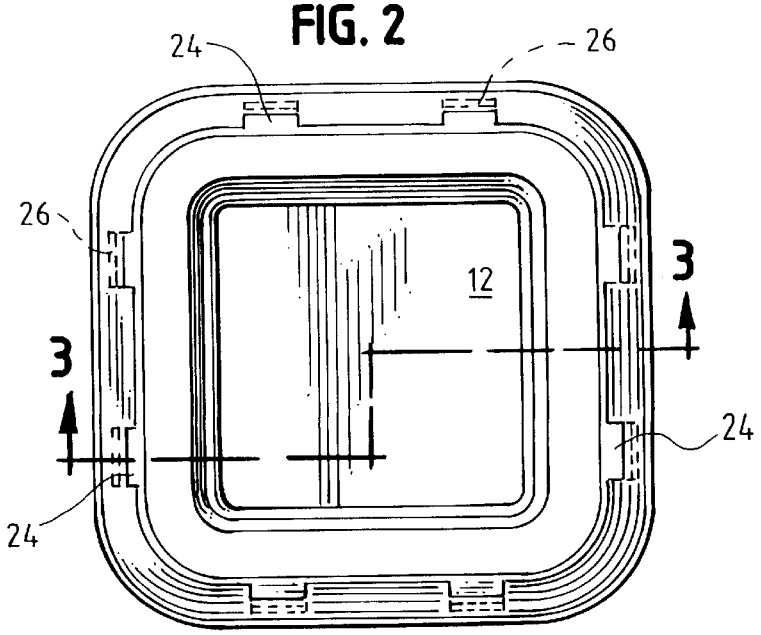
FIG. 2 is a plan view of the lid of FIG. 1.
Figure 3:
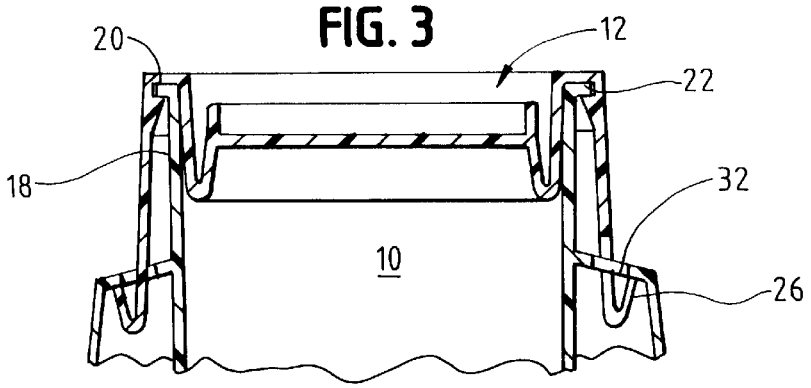
FIG. 3 is a sectional view taken along line 3—3 of the container and lid of FIG. 2 when in their connected position.

It can be seen that each of the molded parts 10, 12 of the container of FIGS. 1–3 is readily moldable by injection molding at a rapid piece rate and at relatively low cost. Thus, large containers are provided for the first time which are of relatively low cost, being easily molded, two-piece containers, rather than the prior art three-piece containers, but which still have great resistance against lid pop-off until opened for the first time.

This opening may be accomplished by cutting most or all of strips 24, following which, the lid is conventionally openable and reclosable again by the opening and closing of the second snap-latch system 22

Figure 4:
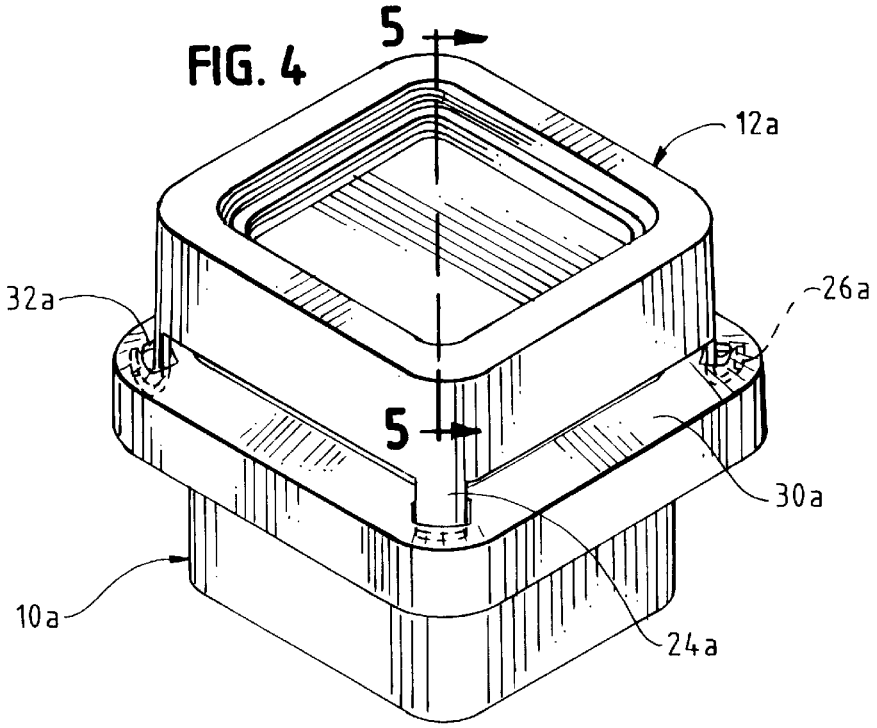
FIG. 4 is a perspective view of another, similar connected container and lid.
Figure 5:
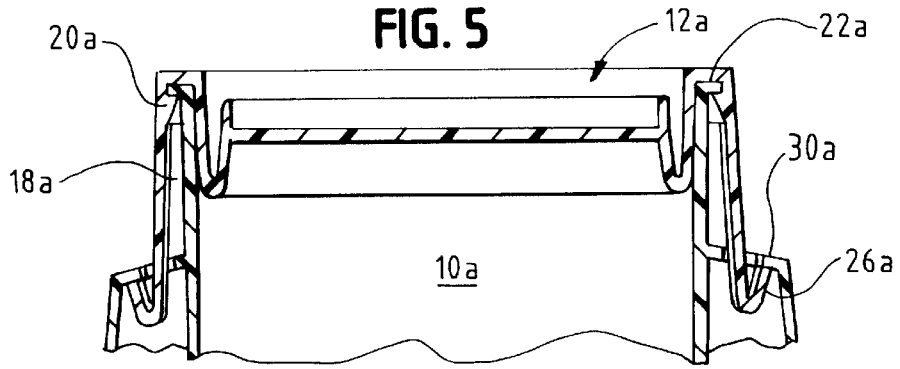
FIG. 5 is a sectional view taken along line 5—5 of the container and lid of FIG. 4.

Referring to FIGS. 4 and 5, another embodiment of rectangular container is shown in which the integral extending members 24*a* of lid 12*a* are positioned at the corners of the lid, with the respective apertures 32*a* of container 10*a* being correspondingly positioned at the corners of facing wall 30*a* of the container. The hooking action of latch members 26*a* against the underside of facing wall 30*a* can be seen. A second snap-latch system 22*a*, similar to that of FIGS. 1 through 3, can also be seen, so that the container and lid system of FIGS. 4 and 5 can be seen to be otherwise similar to that of the previous embodiment both in structure and function, except as otherwise described here. The closed loop aperture 18*a* and the inwardly extending, continuous loop flange 20*a* are also shown, being of similar design to the previous embodiment.

Figure 6:
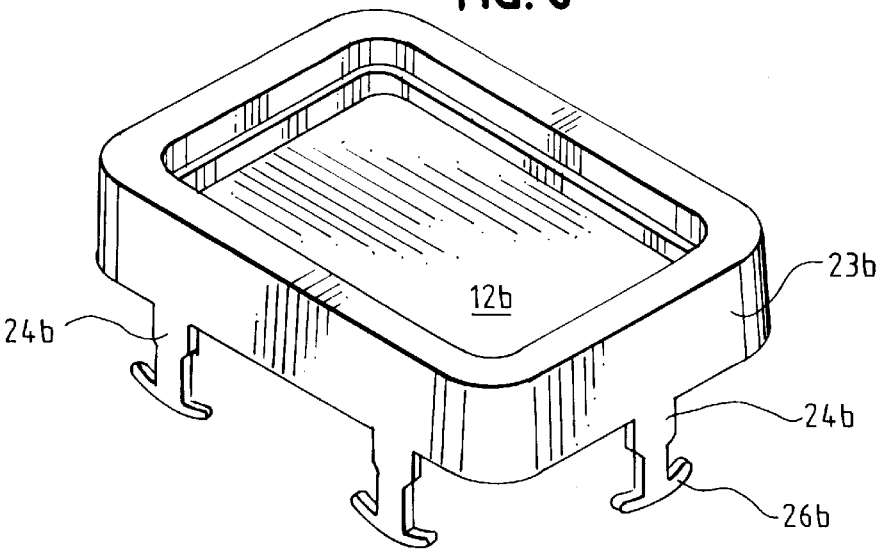
FIG. 6 is a perspective view of another embodiment of a lid for a container.
Figure 7:
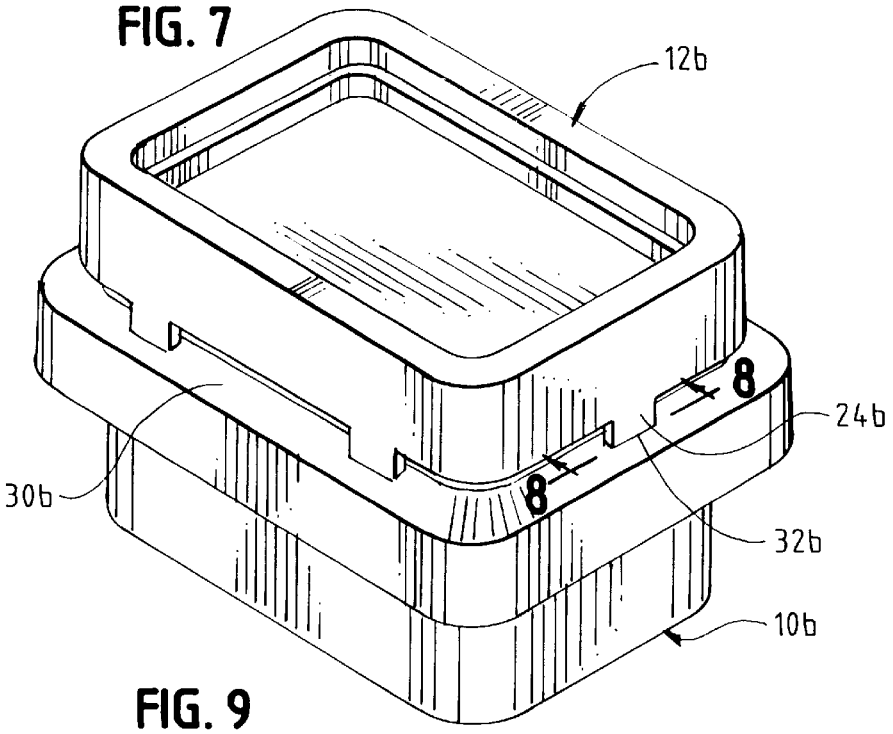
FIG. 7 is a perspective view showing the lid of FIG. 6 in connected position with a container of this invention.
Figure 8:
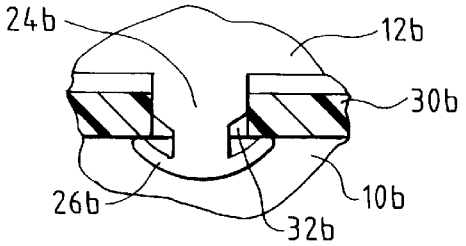
FIG. 8 is a sectional view taken along line 8—8 of FIG. 7.

Referring to FIGS. 6–8, another embodiment of container and lid system is shown, and container lid 12*b* is generally of the same design, being rectangular and having an outer, depending skirt 23*b* which carries in integral manner a plurality of integral, extending members 24*b* ending in latch members 26*b* at the free ends thereof. In this embodiment, latch members 26*b* may be a substantially T-shaped, being somewhat resilient. FIG. 7 shows container 10*b* and lid 12*b* in their connected position, with extending strip members 24*b* passing through the respective apertures 32*b* formed in facing wall 30*b*.

Figure 9:
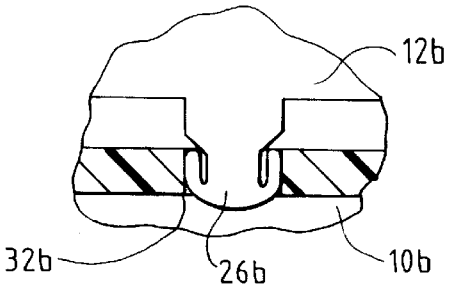
FIG. 9 is a sectional view similar to FIG. 8, but showing an intermediate position in which a latch member is shown in a flexed configuration in an aperture as the lid is being attached to the container.

As lid 12*b* and container 10*b* are snapped together into the connected position, FIG. 9 shows how the arms of T-shaped latch 26*b* are flexed inwardly by the dimensions of aperture 32*b* so that, when they flex out again as shown in FIG. 8, a strongly resistant locking of the lid and container together is provided until integral, extending member strips 24*b* are severed by the user for opening of the container. This is easily done with a sharp knife when a normal plastic such as polyethylene is used.

Figure 10:
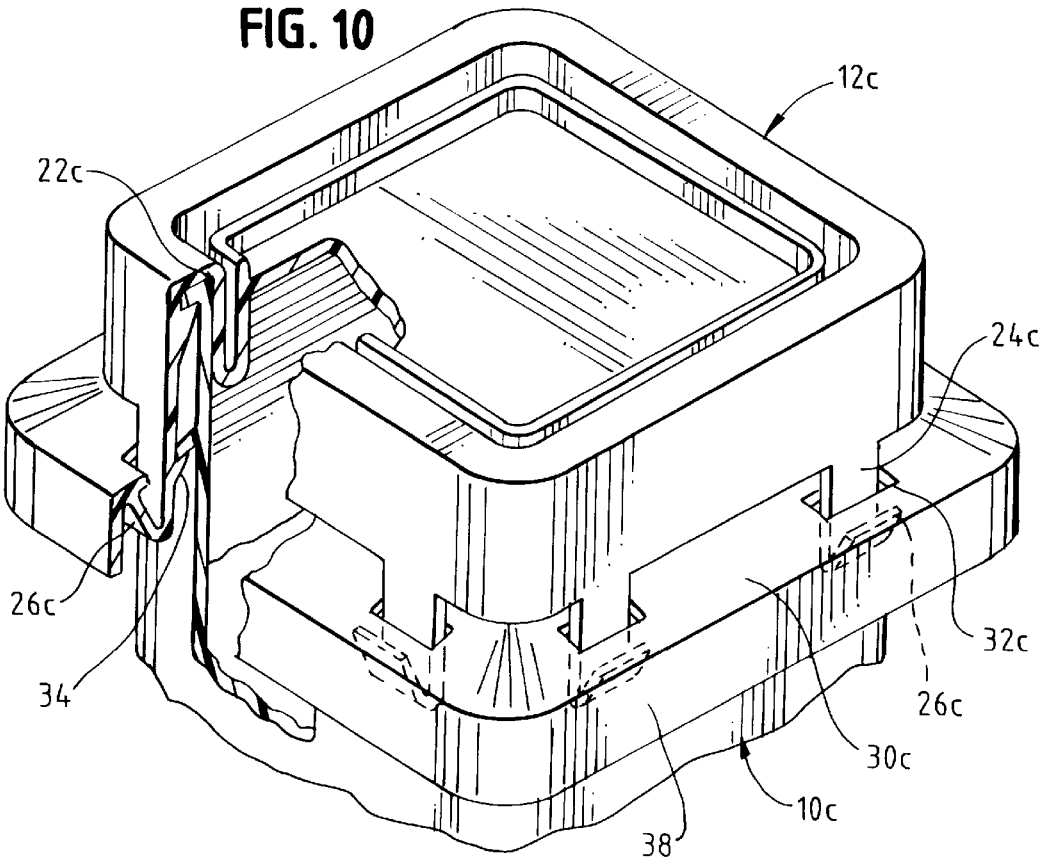
FIG. 10 is a perspective view, with portions broken away, of another embodiment of a connectable container and lid system in accordance with this invention, shown in connected position.
Figure 11:
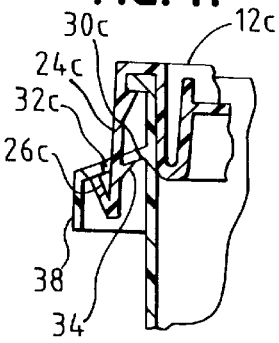
FIG. 11 is a fragmentary, sectional view taken along line 11—11 of FIG. 10.

Referring to FIGS. 10 and 11, a similar container and lid system is provided, in which container 10c and container lid 12*c* are of similar design to the design of FIG. 1, having a second snap-latch system 22*c* for circumferential sealing of the two parts, and the lid providing integral, extending member strips 24*c* that are latched into apertures 32*c* by latch members 26*c*. Latch members 26*c* are flexed inwardly as they pass through apertures 32*c*, all as in the previous embodiment. However, in this embodiment, a spur member 34 is provided, extending away from hook 26*c* on the other side of integral, extending member strips 24*c*. Spur member 34 can be seen to have a downwardly facing, angled side to facilitate its passage through aperture 32*c* while latch 26*c* is compressed in its passage through the aperture. Then, when the latch 26*c* has completely passed through aperture 32*c*, it springs back again, with spur member 34 providing additional securance and strength to the latch, so that lid 12*c* cannot be effectively forced out of its connected position without first severing extending member strips 24*c*.

Figure 12:
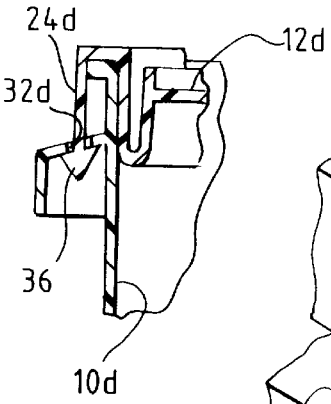
FIGS. 12 and 13 are each sectional views similar to FIG. 11, respectively showing different designs of latch member.

FIG. 12 shows a detail of another embodiment similar to the embodiment of FIGS. 10-11, but where the latch member 36 carried on the respective extending member strips 24*d* (similar to the previous strips 24 and 24*a–c*) is in the form of an arrowhead. In this embodiment, while some flexing of latch member 36 takes place, flexing also takes place in the plastic around aperture 32*d*, which is analogous to the previous aperture of reference numeral 32*d*, to lock lid 12*d* onto its container 10d. Apart from this, the structure and function of the lid and container of FIG. 12 are essentially the same as in previous embodiments.

Figure 13:
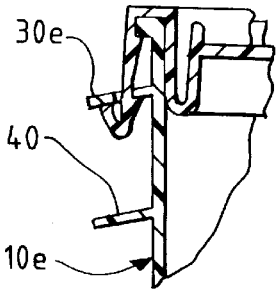

FIG. 13 shows another embodiment which is slightly modified from that of FIG. 11, in that a different design for container 10e is provided. Whereas in FIG. 10, apertures 32*c* are defined in a flange comprising a pair of planes, namely facing wall 30*c*, which is joined to a circumferential wall 38, in the embodiment of FIG. 13, a facing wall 30*e* is present without a circumferential wall similar to wall 38. A second flange 40 is also provided on bucket 10*e*, spaced from facing wall 30*e*. Apart from this, the remaining components of the bucket and lid system are identical to that of FIG. 10 and previous embodiments.

Figure 14:
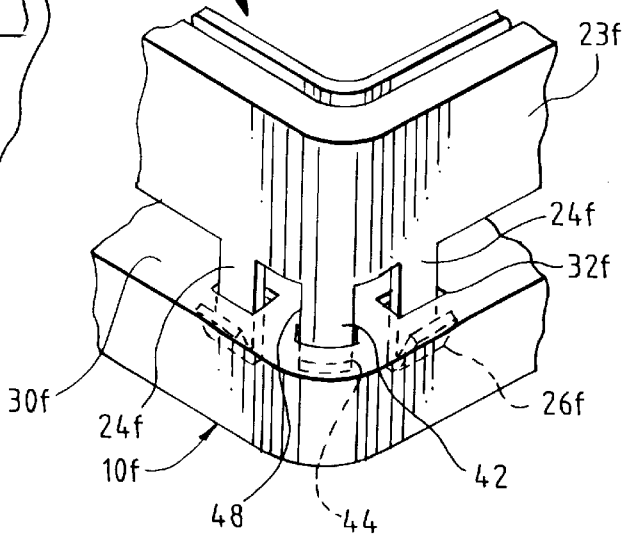
FIG. 14 is a fragmentary view of a modification of the container and lid of FIG. 10, showing a child-proof openable latch feature.

Referring to FIG. 14, a fragmentary view of a bucket 10f and its lid 12 is shown in connected position. Connecting member strips 24*f* are shown, carried near each corner of lid flange 23*f* as in the previous embodiments. Connecting member strips pass into apertures 32*f* and are retained there by latch members 26*f*, which are of hook form as previously disclosed in other embodiments.

In this embodiment, lid 12*f* has at each corner an added type of extending member strip 42, similar in structure to the previous extending members 24 of the various embodiments, and having a latch member 44 on its lower, free end of a design similar to that shown hooks 26 of the various embodiments. An aperture 48 is provided in the facing wall 30*f*, similar to the adjacent apertures 32*f* of previously-described function. However, apertures 48, which may be placed if desired at diametrically opposed corners of the container system and not found in the other two corners, may be oversized compared with apertures 32*f* to permit manual disengagement of the added, integral extending members 42 from the added apertures 48, without the need to break away the added extending members 42. Thus, the lid can have an added, child-proof feature if desired, in that it cannot be opened until the added integral, extending members 42 are deflected and permitted to be removed from the added apertures by such deflection. Thus, it is not necessary to sever the added integral, extending members 42 prior to opening, so that they may be reused upon reclosing of the lid for added security of closure.

The above has been offered for illustrative purposes only, and is not intended to limit the scope of the invention of this application, which is as defined in the claims below.

That which is claimed:

1. A two-piece, connectable article which comprises a first piece and a second piece which fit together in a connected position, one of said first and second pieces having a plurality of integral, extending members having free ends that each define a latch member; the other of said first and second pieces having a facing wall that defines a plurality of apertures positioned to receive the free ends of the extending members in said connected position, said apertures being sized to cause flexing of said latch members as said latch members are placed through said apertures to assume said connected position, said extending members and facing wall being proportioned to permit said latch members to spring back toward an original position in said connected position, to effectively prevent separation of the first and second pieces until at least some of said extending members are broken away, at least some of said extending members being exposed to the exterior at a point between the first and second pieces and spaced from their ends to permit them to be easily severed.

2. The article of claim 1 in which said latch members are substantially of T shape.

3. The article of claim 1 in which said latch members are substantially of arrowhead shape.

4. The article of claim 1 in which a second, snap-latch system is provided for latching the first and second pieces together in the connected position, said second snap-latch system permitting repeated, non-destructive connection and separation of the first and second pieces.

5. The article of claim 1 in which one of said pieces has added integral, extending members and latch members that can pass into added apertures of the other of said pieces, said added apertures being oversized to permit effective, manual disengagement of said added, integral, extending members from said added apertures without breaking away of said added extending members.

6. The article of claim 1 in which said first and said second pieces respectively comprise a container and lid.

7. The article of claim 6 in which said container and lid are substantially rectangular in cross-section.

8. The article of claim 1 in which said latch members comprise a hook.

9. The article of claim 8 in which said latch members also comprise a spur member extending away from said hook, for engaging a back surface of said facing wall in locking manner.

10. A two-piece, connectable article which comprises a first piece and a second piece which fit together in a connected position, one of said first and second pieces having a plurality of integral, extending members having free ends that each define a latch member; the other of said first and second pieces having a facing wall that defines a plurality of apertures positioned to receive the free ends of the extending members in said connected position, said apertures being sized to cause flexing of said latch members as said latch members are placed through said apertures to assume said connected position, said extending members and facing wall being proportioned to permit said latch members to spring back toward an original position in said connected position, to effectively prevent separation of the first and second pieces until at least some of said extending members are broken away, said latch members comprising a hook, and also comprising a spur member extending away from said hook, for engaging a back surface of said facing wall in locking manner.

11. The two-piece article of claim 10 in which a second snap-latch system is provided for latching said container and lid together in the connected position, said second snap-latch system permitting repeated, non-destructive connection and separation of the container and lid.

12. The two-piece article of claim 10 in which one of said pieces have added, integral extending members and latch members that can pass into added apertures of the other of said pieces, said added apertures being oversized to permit manual disengagement of said added, integral, extending members from said added apertures, without the breaking away of said added extending members.

13. The two-piece connectable article of claim 10 in which said first piece and said second piece comprise a container and a lid.

14. The two-piece connectable article of claim 13 in which said container and lid are substantially rectangular in cross section.

15. A two-piece, connectable article which comprises a first piece and a second piece which fit together in a connected position, one of said first and second pieces having a plurality of integral, extending members having free ends that each define a latch member; the other of said first and second pieces having a facing wall that defines a plurality of apertures positioned to receive the free ends of the extending members in said connected position, said apertures being sized to cause flexing of said latch members as said latch members are placed through said apertures to assume said connected position, said extending members and facing wall being proportioned to permit said latch members to spring back toward an original position in said connected position, to effectively prevent separation of the first and second pieces until at least some of said extending members are broken away, further in which one of said pieces has added integral, extending members and latch members that can pass into added apertures of the other of said pieces, said added apertures being oversized to permit effective, manual disengagement of said added, integral, extending members from said added apertures without breaking away of said added extending members.

16. The two-piece connectable article of claim 15 in which said first piece and said second piece respectively comprise a container and a lid.

17. The two-piece connectable article of claim 16 in which said container and lid are substantially rectangular in cross section.

18. The article of claim 17 in which said latch members comprise a hook.

19. The article of claim 17 in which said latch members are of substantially T-shape.

20. The article of claim 17 in which said latch members are substantially of arrowhead shape.

* * * * *